US006964319B2

(12) United States Patent
Anderson

(10) Patent No.: US 6,964,319 B2
(45) Date of Patent: Nov. 15, 2005

(54) RETRACTABLE LANYARD SYSTEMS, ANCHORING BRACKETS FOR RETRACTABLE LANYARDS AND METHODS OF ANCHORING RETRACTABLE LANYARDS

(75) Inventor: Preston L. Anderson, Seneca, PA (US)

(73) Assignee: Bacou-Dalloz Fall Protection, Inc., Franklin, PA (US)

( * ) Notice: Subject to any disclaimer, the term of this patent is extended or adjusted under 35 U.S.C. 154(b) by 0 days.

(21) Appl. No.: 10/640,092

(22) Filed: Aug. 13, 2003

(65) Prior Publication Data

US 2005/0034920 A1 Feb. 17, 2005

(51) Int. Cl.[7] ..... A62B 1/10; A62B 1/08
(52) U.S. Cl. ..... 182/235; 182/231
(58) Field of Search ..... 182/3, 231, 232, 182/233, 36, 237–239, 240, 113, 235; 242/398, 242/588, 379, 134, 379.2, 137, 381.5, 383, 242/375, 383.4; 248/200, 534, 541, 159, 248/317

(56) References Cited

U.S. PATENT DOCUMENTS 2,598,596 A * 5/1952 Petrie ..... 242/379.2
3,312,451 A * 4/1967 Davis ..... 242/379.2
4,145,027 A * 3/1979 Brimo ..... 182/3
4,687,077 A * 8/1987 Bobick ..... 182/235
5,186,289 A * 2/1993 Wolner et al. ..... 182/232
5,771,993 A * 6/1998 Anderson et al. ..... 182/239

* cited by examiner

*Primary Examiner*—Hugh B. Thompson, II
(74) *Attorney, Agent, or Firm*—Bartony & Hare, LLP

(57) ABSTRACT

An anchoring system includes an anchor member to anchor the lifeline and at least one extending unit to extend the anchor member out to a working position beyond (horizontally) and above (vertically) an edge to provide for an overhead anchoring point. The anchoring system preferably further includes a support to which the extending unit is attached. The support immobilizes the overhead anchoring system so that the anchor member remains at the working position (even in the case of a fall by the worker). A method of anchoring a fall protection lifeline for use by a worker working at or beyond an edge includes the steps: elevating an anchor member to position the lifeline above the head of a worker and supporting the anchor member at the working position. The method can also include the step of extending the anchor member to a working position horizontally beyond and above the edge.

10 Claims, 6 Drawing Sheets

200
210
220
230
232
234
236
238
240
242
244
246a
246b
246c
246d
60
61
62
64
66
68
50
A
A'
A1
A2

RETRACTABLE LANYARD SYSTEMS, ANCHORING BRACKETS FOR RETRACTABLE LANYARDS AND METHODS OF ANCHORING RETRACTABLE LANYARDS

BACKGROUND OF THE INVENTION

The present invention relates to self-retracting or retractable lanyard systems, to anchoring brackets for retractable lanyards and to methods of anchoring retractable lanyards, and, especially, to retractable lanyards, to anchoring brackets for retractable lanyards and to methods of anchoring retractable lanyards that facilitate movement of a user of a retractable lanyard to positions not directly vertically under the anchor point of the retractable lanyard.

Fall protection systems including safety harnesses and lanyards such as self-retracting or retractable lanyards are commonly used to protect persons subjected to the potential of a fall from a height. Often, a lifeline or lanyard is connected to an overhead anchorage point on a structure directly over the user. However, in many cases the anchor point and the worker's position result in a horizontal component to the vector corresponding to the line between the anchor point and point at which the lanyard is connected to the worker.

In one of many examples, in leading edge work and work on the highest completed deck of a construction project, a fall protection anchorage directly overhead of a worker or workers may not exist. Recently, an anchorage system has been developed to create an overhead anchorage point for such leading edge work as disclosed in U.S. patent application Ser. No. 10/100,532, filed Mar. 18, 2002, assigned to the assignee of the present invention, the disclosure of which is incorporated herein by reference. Even with use of such an anchorage system, the anchor point of a retractable lanyard may not be directly vertically above a worker to which the lanyard is attached. The horizontal component thereby created can lead to improper operation of the retractable lanyard. In that regard, binding of the lanyard can occur at the outlet of the retractable lanyard causing excessive wear to the line constituent of the retractable lanyard.

It is desirable, therefore, to develop devices, systems and methods that reduce or eliminate problems associated with the horizontal component of the lifeline vector.

SUMMARY OF THE INVENTION

In one aspect, the present invention provides a retractable lanyard system including a bracket into which a retractable lanyard can be placed in operative connection. The retractable lanyard includes a housing and a lifeline exiting the housing. The bracket includes a frame member having attached thereto an anchor member adapted to be attached to an anchorage point. The frame is rotatable relative to the anchor member about a first axis. The bracket further includes a cradle member rotatably attached to the frame member about a second axis. The second axis is generally orthogonal to the first axis. The cradle is adapted to hold the retractable lanyard in operative connection with the bracket.

In one embodiment, the retractable lanyard is removable from the cradle. Preferably, the first axis and the second axis pass sufficiently close to the center of gravity of the retractable lanyard to allow the bracket to orient the retractable lanyard generally in the direction of the lifeline exiting the housing of the retractable lanyard under the force applied by the lifeline to the housing of the retractable lanyard. Given the typical size of retractable lanyard, the pivot point of the second axis is preferably within approximately one inch of the center of gravity of the retractable lanyard. In one embodiment, as used in connection with the MILLER MIGHTYLITE® self-retracting lifeline, available from Bacou-Dalloz Fall Protection of Franklin, Pa., for example, the second axis (or the pivot point of the bracket) was about 0.7 inches above the center of gravity of the retractable lanyard. Preferably, the pivot point lies slightly above the center of gravity so that the retractable lanyard remains upright when not in use, although this is a convenience and not a requirement. The retractable lanyard system can further comprising a retractable lanyard.

In another aspect, the present invention provides a retractable lanyard system, including a retractable lanyard, which includes a housing and a lifeline exiting the housing, and a bracket into which a retractable lanyard can be placed in operative connection. The bracket includes a frame member having attached thereto an anchor member adapted to be attached to an anchorage point. The frame is rotatable relative to the anchor member about a first axis. The bracket further includes a shaft attached to the frame member to pass through the housing of the retractable lanyard. The retractable lanyard is rotatable about a second axis defined by and collinear with the shaft. The second axis is generally orthogonal to the first axis.

As discussed above, the first axis and the second axis preferably pass sufficiently close to the center of gravity of the retractable lanyard to allow the bracket to orient the retractable lanyard generally in the direction of the lifeline exiting the housing of the retractable lanyard under the force applied by the lifeline to the housing of the retractable lanyard.

In still a further aspect, the present invention provides method of anchoring a retractable lanyard to an anchorage, comprising the step: placing a retractable lanyard in operative connection with bracket, the bracket comprising a frame member, the frame member having attached thereto an anchor member adapted to be attached to an anchorage point, the frame being rotatable relative to the anchor member about a first axis, the bracket further comprising a lanyard attachment attached to the frame member to which the retractable lanyard in operatively connected, the lanyard attachment being rotatable about a second axis defined by and collinear with the shaft,

DETAILED DESCRIPTION OF THE INVENTION

In general, the retractable lanyard systems of the present invention can incorporate commercially available retractable lanyards therein. In several embodiments of the present invention, such commercially available lanyards need not be retrofitted or changed in any manner for use in the systems of the present invention. An example of a commercially available, retractable lanyard suitable for use in the present invention is the MILLER MIGHTYLITE® self-retracting lifeline, available from Bacou-Dalloz Fall Protection of Franklin, Pa. See also, for example, U.S. Pat. No. 5,771,993, assigned to the assignee of the present invention, the disclosure of which is incorporated herein by reference, for an example of a retractable lanyard system.

Figure 3A:
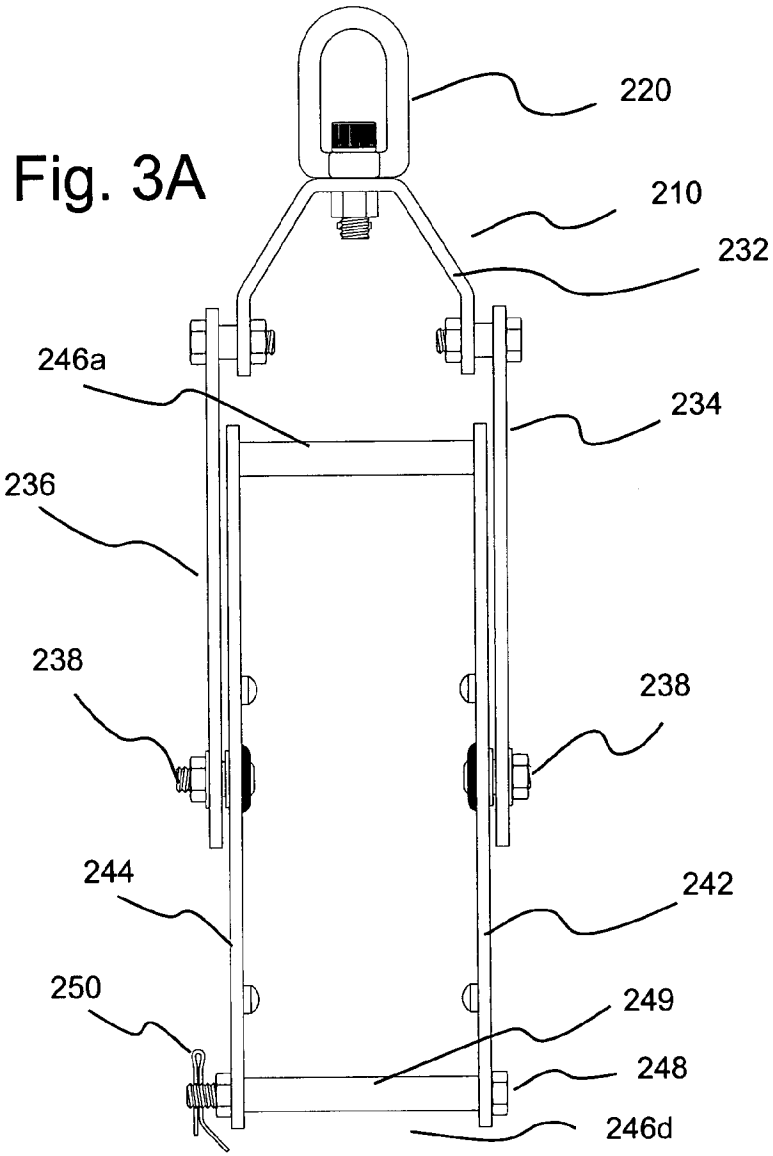
FIG. 3A illustrates a front view of the support frame the retractable lanyard system of FIG. 1.
Figure 3C:
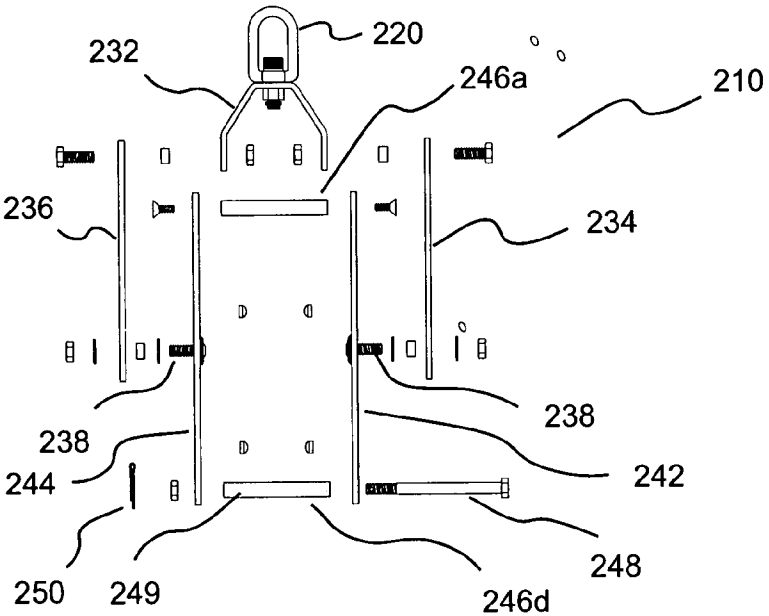
FIG. 3C illustrates an exploded front view of the support frame of the retractable lanyard system of FIG. 3A.
Figure 3B:
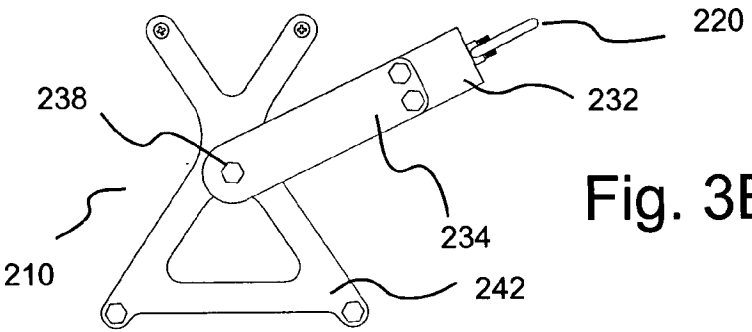
FIG. 3B illustrates a side view of the support frame of the retractable lanyard system of FIG. 3A.
Figures 3D, 3E, 3F, 3G:
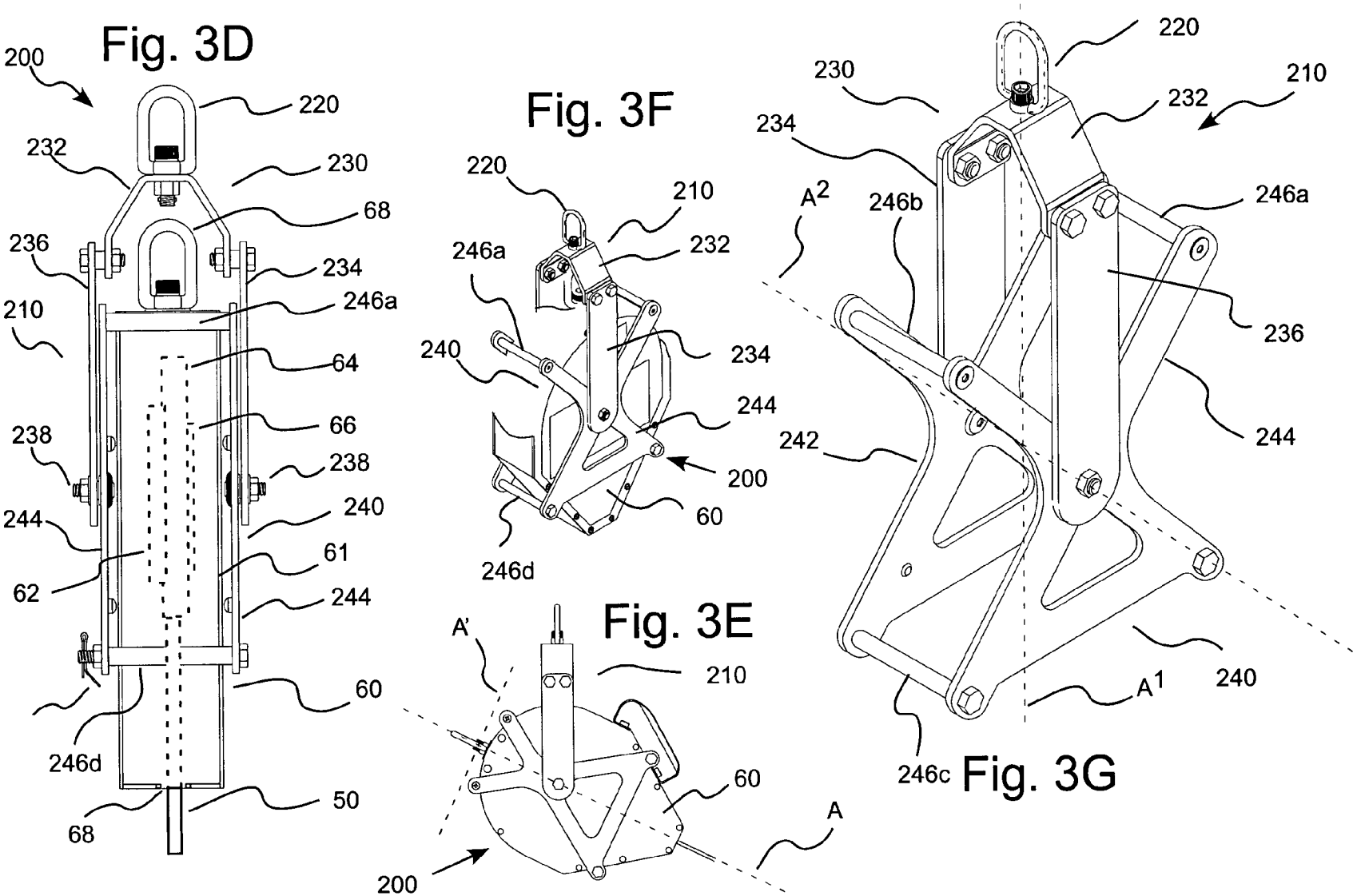
FIG. 3D illustrates a front view of the retractable lanyard system of FIG. 1A showing several of the internal components of the retractable lanyard in dotted lines in a schematic manner.
FIG. 3E illustrates a side view of the retractable lanyard system of FIG. 3D.
FIG. 3F illustrates a perspective view of the retractable lanyard system of FIG. 3D.
FIG. 3G illustrates a perspective view of the support frame of FIG. 3A.

As described, for example, in U.S. Pat. No. 5,771,993, retractable lanyards such as retractable lanyard 60 typically include a housing 61 incorporating a breaking mechanism 62 (see, for example, FIG. 3D) to arrest the fall of a mass or person attached thereto once an internal, tensioned drum 64 (see, for example, FIG. 3D) reaches a predetermine angular velocity (corresponding to a certain rate of fall). The drum of self-retractable lanyard 60 is preferably under adequate rotational tension (provided, for example, by a spring 66) to reel up excess extended lifeline 50 without hindering the mobility of the user 10. Lifeline 50 exits housing 61 via opening 68. Lanyard 50 can, for example, be connected to a D-ring 70 of a safety harness 80 worn by worker 10.

Figure 1:
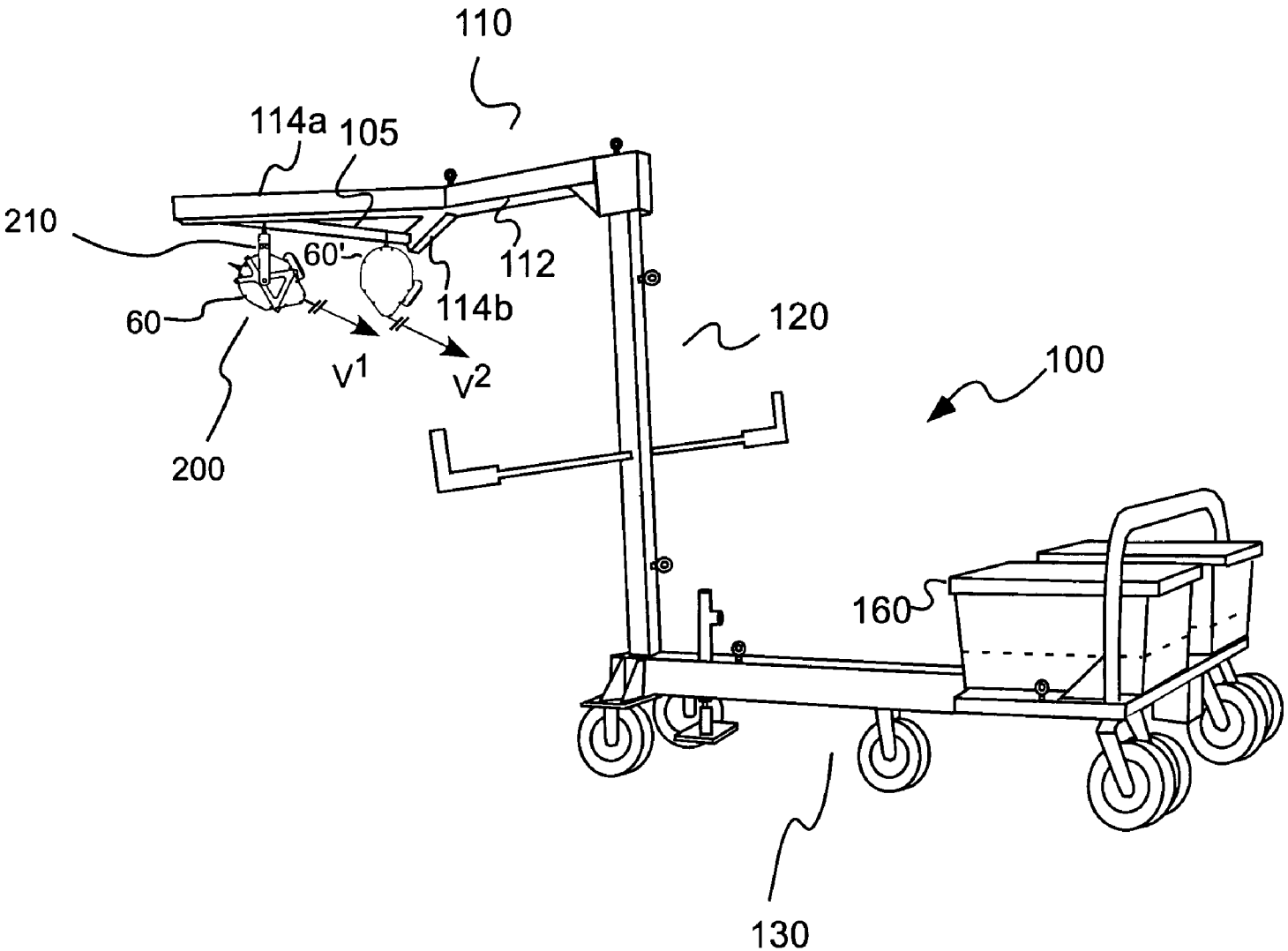
FIG. 1 illustrates a perspective view of one embodiment of a retractable lanyard system of the present invention anchored to an elevated anchoring system.
Figure 2:
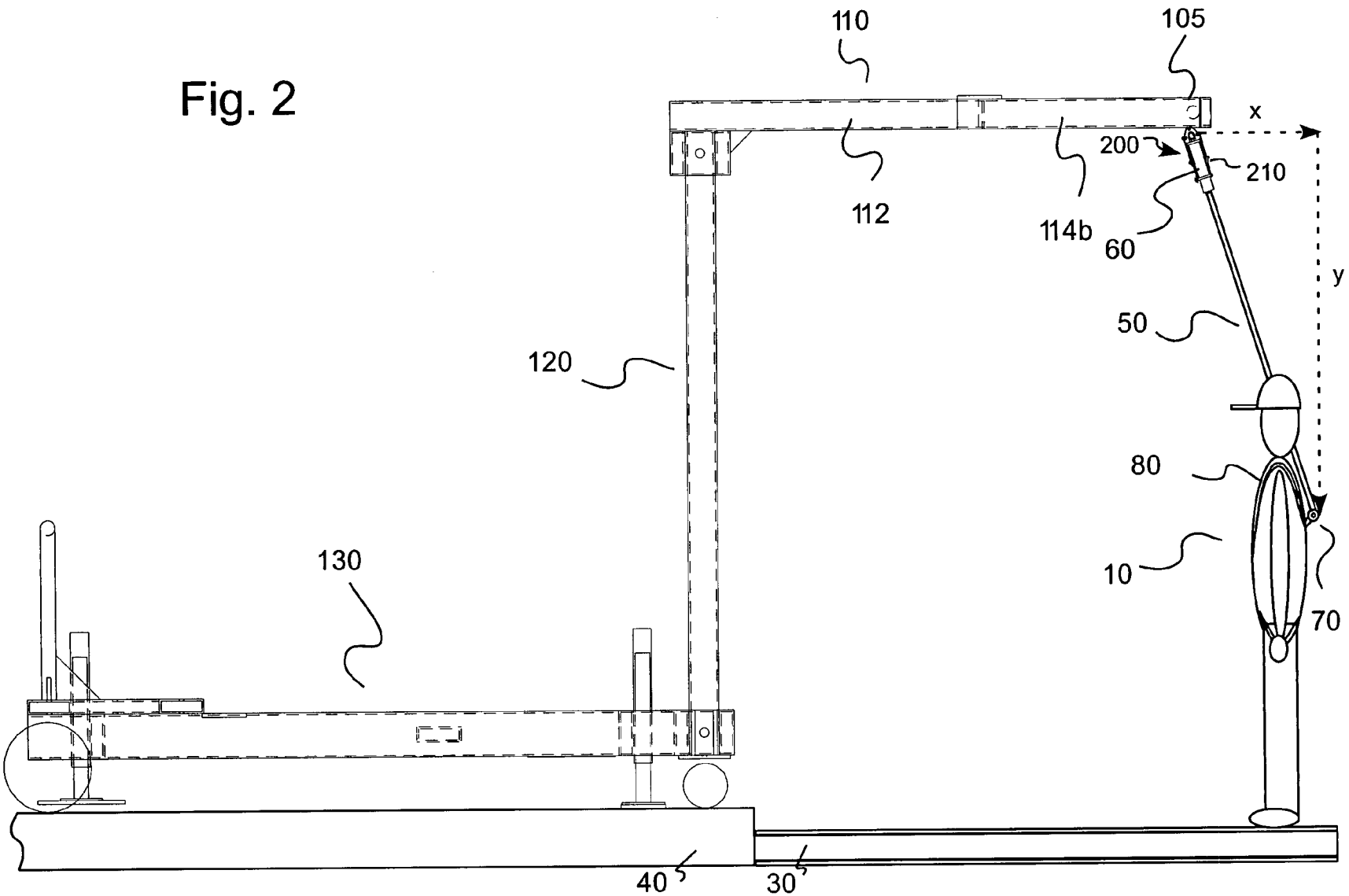
FIG. 2 illustrates a side view of the retractable lanyard system and anchoring system of FIG. 1.

In the representative embodiment illustrated in FIGS. 1 and 2, retractable lanyard system 200 of the present invention is illustrated anchored to a mobile overhead anchoring device or system 100. The mobile anchoring system 100 includes an anchor member 105 attached to one end of a generally horizontally extending member 110. In the embodiment of FIGS. 2–5B, horizontal extending member 110 includes a first generally horizontal member 112 to which two extending member 114*a* and 114*b* are attached at generally opposing angles in the form of a "Y". Anchor member 105, in this embodiment, is a transverse bar extending between the forward end of extending members 114*a* and 114*b*. Anchor member 105 can, alternatively, be attached directly to a horizontal extending member such as generally horizontal member 112 in the general form of a "T".

As used herein, the term "forward" refers to a direction toward the anchor member of the anchoring devices or systems of the present invention. The term "rearward: refers to an opposite direction, away from the anchor member.

Generally horizontal extending member 110 is attached at its rearward end to the elevated end of generally vertically extending member 120. The opposite and lower end of vertically extending member 120 is attached to the front end of a mobile support 130. Weighted members 160 are preferably positioned at the rear end of support 130 to provide a counterweight to prevent overhead anchoring system 100 from tipping forward when a load (for example a person suspended by a lifeline) is applied to anchor member 105 through, for example, a lifeline 50 attached to D-ring 70 of safety harness 80 as worn by a worker 10 (see FIG. 2). An example of a safety harness suitable for use in connection with the anchoring systems of the present invention is described in U.S. Pat. No. 6,006,700, the disclosure of which is incorporated herein by reference.

Mobile overhead lifeline anchorage 100 provides substantially improved protection for construction workers working on the leading edge of deck placement or working on the highest completed deck of a construction project as compared to prior practices as described in U.S. patent application Ser. No. 10/100,532, filed Mar. 18, 2002, assigned to the assignee of the present invention, the disclosure of which is incorporated herein by reference. Like other overhead overage anchorages, however, a worker is often not directly under retractable lanyard 60 attached to the anchorage. This, for example, gives rise to a "horizontal components" in the vector representative of the line between the anchor point and the attachment point (D-ring 70) of lifeline 50. Such horizontal components can be in the plane of the illustration of, for example, FIG. 2 (represented by arrow "x") or perpendicular to that plane (that is, in the "z" axis, not shown). As discussed above, the horizontal component(s) thereby created can lead to improper operation of the retractable lanyard (for example, binding of the lifeline at the outlet of the retractable lanyard).

Retractable lanyard system 200 of the present invention, substantially prevents such malfunction of retractable lanyard 60 (or other retractable lanyards) by allowing retractable 50 (and, thereby, outlet 68) to be oriented in the general direction of the line or vector between the anchoring point of retractable lanyard system 200 and D-ring 70. Currently available retractable lanyards such as retractable lanyard 60 typically include an attachment member 69 on an end of housing 61 opposite of outlet 68 allowing rotation of retractable lanyard 60 around axis A (see FIG. 3E). Attachment member 69 may also provide for limited swiveling of rotation of retractable lanyard 60 about axis A' (see FIG. 3E). However, because axis A' is so far removed from the center of gravity of retractable lanyard 60, a substantial amount of force, when applied, for example, at outlet 68, is required to cause such swiveling.

For example, a retractable lanyard 60' (identical to retractable lanyard 60) is illustrated in FIG. 1 attached to anchor member 105. Lifeline 50' of retractable lanyard 60' is oriented in a direction dictated by the position of the user/worker (not illustrated in FIG. 1) and represented by vector $V^2$. The limited mobility of retractable lanyard 60', once anchored, does not allow retractable lanyard to orient in the general direction of lifeline 50' (that is, in the general direction of vector $V^2$) under the force applied by lifeline 50'. In that regard, the force applied to retractable lanyard 60' at outlet 68' thereof by lifeline 50' is insufficient to cause retractable lanyard 60' to orient in the direction of vector $V^2$. The angle at which lifeline 50 exits the housing of retractable lanyard 60' with respect to that housing can lead to malfunction of retractable lanyard 60' as discussed above.

On the other hand, as also illustrated in, for example, FIG. 1, retractable lanyard system 200, which includes retractable lanyard 60, readily orients in substantially the direction of lifeline 50 or vector $V^1$ (defined by the position of the user/worker) under the force applied by lifeline 50. In that regard, retractable lanyard system 200 provides for rotational motion of a bracket or support member 210 for retractable lanyard 60 about two generally orthogonal axes $A^1$ and $A^2$ as illustrated, for example, in FIG. 3G. Each of these orthogonal axes preferably pass through or in close proximity to the center of gravity of retractable lanyard 60 when retractable lanyard 60 is within bracket 210. Rotation of bracket 210 about each of axis $A^1$ and axis $A^2$ to orient retractable lanyard 60 thus occurs readily under minimal force. Retractable lanyard system 200 of the present invention, substantially prevents malfunction of retractable lanyard 60 (or other retractable lanyards) by allowing retractable lanyard 60 (and, thereby, outlet 68) to be substantially oriented in the general direction of the line or vector between the anchoring point of retractable lanyard system 200 and D-ring 70.

In the embodiment of FIGS. 1 through 3G, bracket or support member 210 includes an anchorage attachment member or ring 220 for attachment of bracket 210 to an anchorage point. Attachment ring 220 is rotatably (about Axis A1) attached to central member 232 of a frame 230. Frame 230 also includes two lateral members 234 and 236 with extend downward from central member 232. A cradle 240 is rotatably attached to frame 230 via bolts 238 or other generally cylindrical members about which cradle 240 can rotate. In the embodiment of FIGS. 1 through 3G, cradle 240 includes two generally x-shaped lateral members 242 and 244 connected by cross members 246*a* through 246*d*. One or more of cross members 246*a* through 246*d* can be removable to facilitate insertion and removal of retractable lanyard 60. In the embodiment of FIGS. 1 through 3G, for example, cross member 246*d* includes a bolt 248 that passes through a sleeve 249 and is removably assembled via a removable pin 250.

Figure 4B:
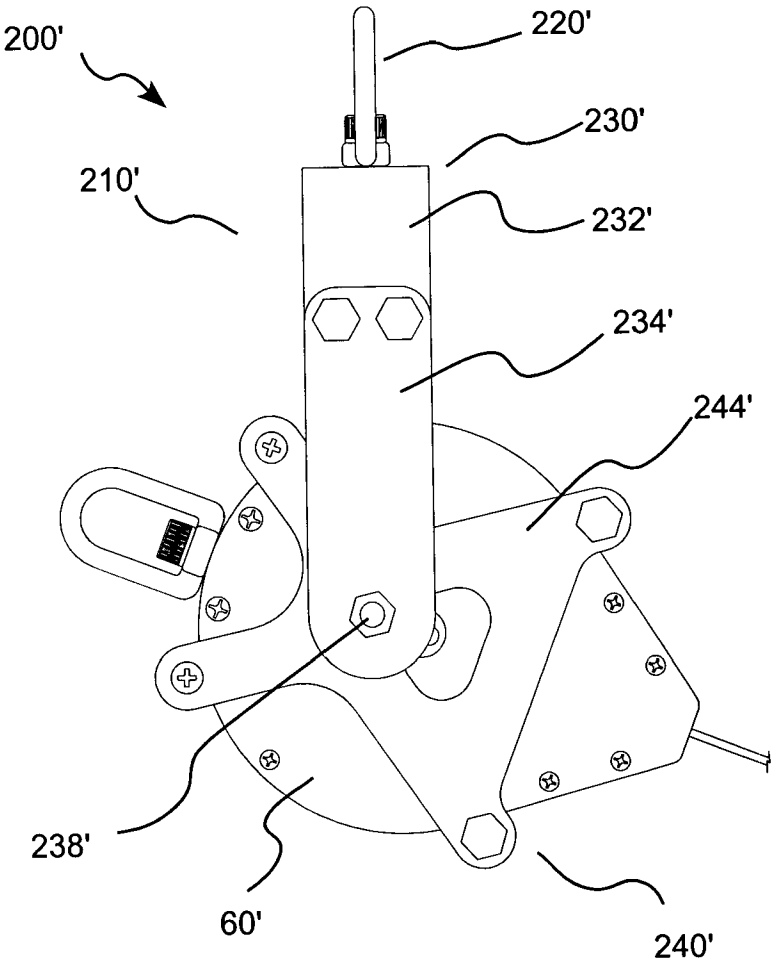
FIG. 4B illustrates a side view of the support frame of FIG. 4A.
Figure 4A:
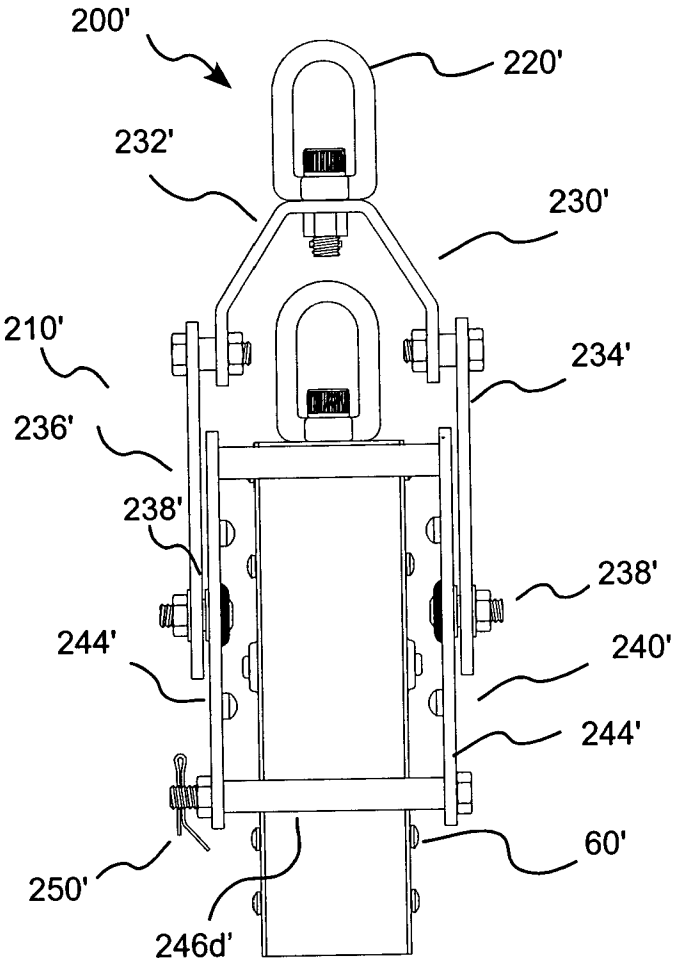
FIG. 4A illustrates a front view of another embodiment of a support frame for use with a retractable lanyard of a smaller size than the retractable lanyard of FIGS. 1A through 3G.

Bracket 210 of system 200 is readily adapted (for example dimensioned) for use with generally any retractable lanyard. For example, FIGS. 4A and 4B illustrate another embodiment of a retractable lanyard system 200' for use with a retractable lanyard 60*a* that is smaller than retractable lanyard 60. In general, retractable lanyard system 200' operates in the same manner as retractable lanyard system 200 and like components are numbered similarly to components of retractable lanyard system with the addition of the designation "'".

Figure 5B:
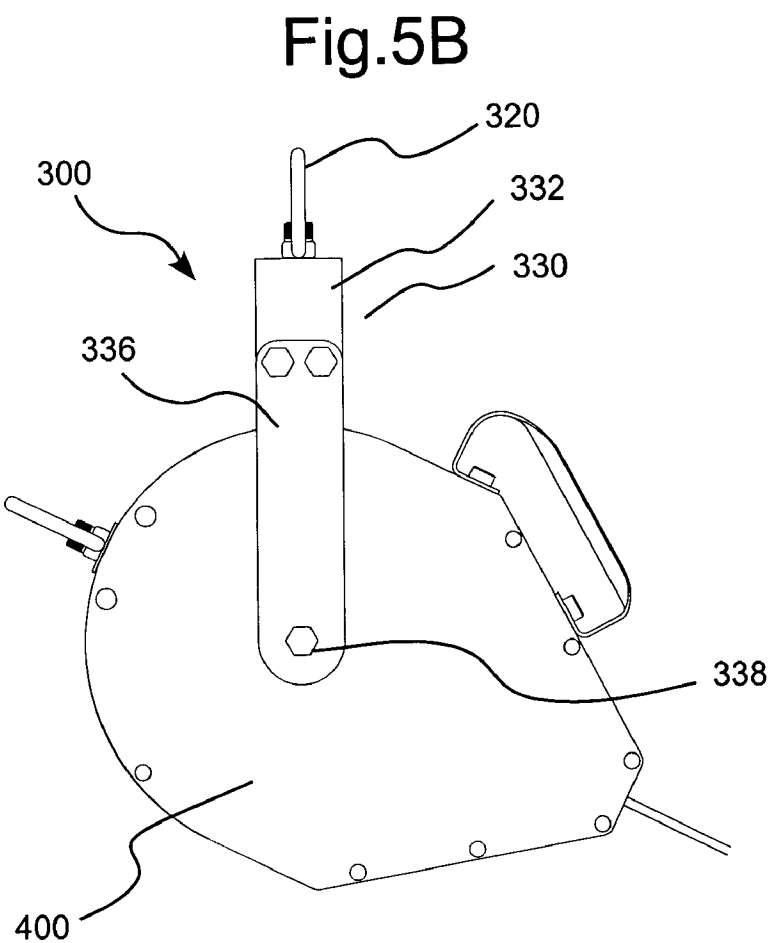
FIG. 5B illustrates a side view of the retractable lanyard system of FIG. 5A.
Figure 5A:
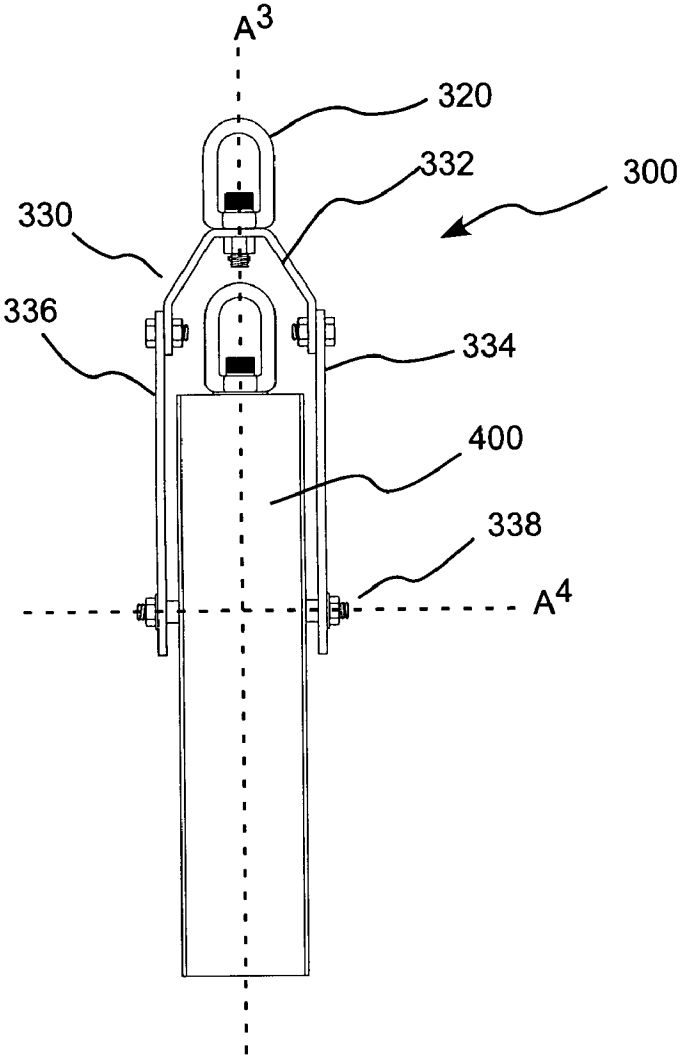
FIG. 5A illustrates a front view of another embodiment of a retractable lanyard system of the present invention.

FIGS. 5A and 5B illustrate another embodiment of retractable lanyard system 300 including a bracket or support member 310 for use with a retractable lanyard 400. Retractable lanyard 400 is rotatably attached to a frame 330 of bracket 310. An anchorage connector such as an anchor ring 320 is rotatably attached to a central, bridging member 332 of frame 330. Frame 330 is preferably rotatable relative to anchor ring 320 about axis $A^3$ as illustrated, for example, in FIG. 5A. Frame 330 also includes generally downward extending lateral members 334 and 336. A generally cylindrical shaft 338 (for example, a bolt) connected between lateral member 334 and 336. Shaft 338 passes through the body of retractable lanyard 400 so that retractable lanyard 400 is rotatable around an axis $A^4$ defined by shaft 338. Axis $A^4$ preferably passes through or in vicinity to the center of gravity of retractable lanyard 400 to facilitate rotation of retractable lanyard 400 therearound upon application of minimal force. Unlike the embodiment of retractable lanyard systems 200 and 200' of the present invention, retractable lanyard system 300 may require slight modification or retrofitting of retractable lanyard 400. Moreover, retractable lanyard systems 200 and 200' can be more easily assembled (that is, the retractable lanyard placed into the bracket thereof) in the field than is the case with retractable lanyard system 300.

Although the present invention has been described in detail in connection with the above examples, it is to be understood that such detail is solely for that purpose and that variations can be made by those skilled in the art without departing from the spirit of the invention except as it may be limited by the following claims.

What is claimed is:

1. A retractable lanyard system, comprising:

a bracket adapted to hold in operable connection therewith a retractable lanyard, the retractable lanyard comprising a housing and a lifeline exiting the housing; the bracket comprising a frame member, the frame member having attached thereto an anchor member adapted to be attached to an anchorage point, the frame being rotatable relative to the anchor member about a first axis, the bracket further comprising a cradle member rotatably attached to the frame member about a second axis, the second axis being generally orthogonal to the first axis, the cradle being adapted to hold the retractable lanyard in operative connection with the bracket.

2. The retractable lanyard system of claim 1 wherein the retractable lanyard is removable from the cradle.

3. The retractable lanyard system of claim 1 wherein the first axis and the second axis pass sufficiently close to the center of gravity of the retractable lanyard to allow the bracket to orient the retractable lanyard generally in the direction of the lifeline exiting the housing of the retractable lanyard under the force applied by the lifeline to the housing of the retractable lanyard.

4. The retractable lanyard system of claim 1 further comprising a retractable lanyard.

5. A retractable lanyard system, comprising:

a retractable lanyard, the retractable lanyard comprising a housing and a lifeline exiting the housing; a bracket adapted to hold the retractable lanyard in operative connection therewith; the bracket comprising a frame member, the frame member having attached thereto an anchor member adapted to be attached to an anchorage point, the frame being rotatable relative to the anchor member about a first axis, the bracket further comprising a shaft attached to the frame member to pass through the housing of the retractable lanyard, the retractable lanyard being rotatable about a second axis defined by and collinear with the shaft, the second axis being generally orthogonal to the first axis.

6. The retractable lanyard system of claim 5 wherein the first axis and the second axis pass sufficiently close to the center of gravity of the retractable lanyard to allow the bracket to orient the retractable lanyard generally in the direction of the lifeline exiting the housing of the retractable lanyard under the force applied by the lifeline to the housing of the retractable lanyard.

7. A method of anchoring a retractable lanyard to an anchorage, comprising the steps:

placing a retractable lanyard in operative connection with bracket, the bracket comprising a frame member, the frame member having attached thereto an anchor member adapted to be attached to an anchorage point, the frame being rotatable relative to the anchor member about a first axis, the bracket further comprising a lanyard attachment attached to the frame member to which the retractable lanyard is operatively connected, the lanyard attachment being rotatable about a second axis defined by and collinear with a shaft, the second axis being generally orthogonal to the first axis.

8. The method of claim 7 wherein the first axis and the second axis pass sufficiently close to the center of gravity of the retractable lanyard to allow the bracket to orient the retractable lanyard generally in the direction of the lifeline exiting a housing of the retractable lanyard under the force applied by the lifeline to the housing of the retractable lanyard.

9. The method of claim 8 wherein the lanyard attachment is a cradle from which the retractable lanyard is removable.

10. The method of claim 8 wherein the lanyard attachment is a shaft attached to the frame member to pass through the retractable lanyard.

* * * * *

UNITED STATES PATENT AND TRADEMARK OFFICE

CERTIFICATE OF CORRECTION

PATENT NO. : 6,964,319 B2
DATED : November 15, 2005
INVENTOR(S) : Preston L. Anderson It is certified that error appears in the above-identified patent and that said Letters Patent is hereby corrected as shown below:

Column 6,
Line 58, after "with" insert -- a --.
Line 60, delete "an" and insert -- a rigid --.
Line 61, after "frame" insert -- member --.

Signed and Sealed this

Eighteenth Day of April, 2006

JON W. DUDAS
*Director of the United States Patent and Trademark Office*